US010434680B2

(12) United States Patent
Kukkonen

(10) Patent No.: US 10,434,680 B2
(45) Date of Patent: Oct. 8, 2019

(54) METHOD FOR PRODUCING A WOOD PRODUCT BY MEANS OF HOT PRESSING AND USE OF METHOD

(71) Applicants: Matti Kukkonen, Helsinki (FI); ILVOLANKOSKI OY, Helsinki (FI)

(72) Inventor: Matti Kukkonen, Helsinki (FI)

(73) Assignee: ILVOLANKOSKI OY, Helsinki (FI)

( * ) Notice: Subject to any disclaimer, the term of this patent is extended or adjusted under 35 U.S.C. 154(b) by 159 days.

(21) Appl. No.: 15/315,919

(22) PCT Filed: May 25, 2015

(86) PCT No.: PCT/FI2015/050358

§ 371 (c)(1),
(2) Date: Dec. 2, 2016

(87) PCT Pub. No.: WO2015/189461

PCT Pub. Date: Dec. 17, 2015

(65) Prior Publication Data

US 2017/0087741 A1 Mar. 30, 2017

(30) Foreign Application Priority Data

Jun. 10, 2014 (FI) ..... 20145534

(51) Int. Cl.
*B27M 1/02* (2006.01)
*B27K 5/06* (2006.01)
(Continued)

(52) U.S. Cl.
CPC ..... *B27M 1/02* (2013.01); *B27K 5/06* (2013.01); *B27M 3/0026* (2013.01); *B05D 3/02* (2013.01);
(Continued)

(58) Field of Classification Search
CPC .... B27M 1/02; B27M 3/0026; B27M 3/0053; B27K 5/06; B27K 3/16; B05D 3/02; B05D 3/12; B05D 7/06
(Continued)

(56) References Cited

U.S. PATENT DOCUMENTS 5,228,209 A * 7/1993 Brunner ..... F26B 7/00 34/417
5,247,975 A * 9/1993 Tanahashi ..... B27M 1/02 144/2.1
6,553,688 B1 * 4/2003 Lee ..... B27M 1/02 144/361

FOREIGN PATENT DOCUMENTS

EP 0110708 6/1984
EP 0460235 A1 12/1991
(Continued)

OTHER PUBLICATIONS

"International Application No. PCT/FI2015/050358, International Preliminary Report on Patentability dated Dec. 15, 2016", (Dec. 15, 2016), 8 pgs.
(Continued)

*Primary Examiner* — George R Koch
(74) *Attorney, Agent, or Firm* — Schwegman Lundberg & Woessner, P.A.

(57) ABSTRACT

A Method of producing a wooden product by means of a molding hot-pressing from a wooden blank which has one or several sections (A, B, C, D). Wherein as a material is selected an optional form of sawn timber or another timber, which is preferably selected from the group consisting of fresh sawn timber, dried timber, saw-surfaced lumber, planed timber, heat-treated timber, sodium silicate water-glass impregnated or salt impregnated or otherwise impregnated timber; wherein molding hot-pressing is performed essentially in a single-stage production process, which includes drying and molding hot-pressing of the wooden blank and essentially concurrent treating of the wooden blank both by binders of the wood itself and by treating chemicals and/or treating materials added in the production process which are selected from the group consisting of surface treatment agents, excipients, primers, impregnating agents, adhesives, adhesive films, adhesive gauzes; wherein the treatment chemicals are attached to the production
(Continued)

Figure 1:
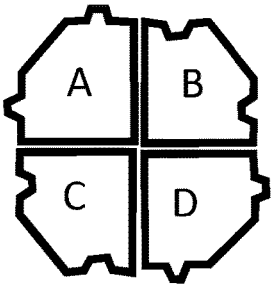

process by using a hot-pressing pressing plate etc., pressing tool or pressing surface; and wherein the wood material, and binders thereof as well as the treating chemicals are allowed to adapt/move in relation to each other in the cooling phase of the production process until the locking phase, whereby the product is completed.

18 Claims, 1 Drawing Sheet

(51) Int. Cl.

| | |
|---|---|
| ***B27M 3/00*** | (2006.01) |
| *B05D 7/06* | (2006.01) |
| *B05D 3/12* | (2006.01) |
| *B05D 3/02* | (2006.01) |
| *B27K 3/16* | (2006.01) |

(52) U.S. Cl.
CPC ..... *B05D 3/12* (2013.01); *B05D 7/06* (2013.01); *B27K 3/16* (2013.01)

(58) Field of Classification Search
USPC ..... 156/64, 351
See application file for complete search history.

(56) References Cited

FOREIGN PATENT DOCUMENTS

| | | | |
|---|---|---|---|
| GB | 624023 | A | 5/1949 |
| GB | 1426555 | | 3/1976 |
| JP | H0866905 | A | 3/1996 |
| JP | 2003145511 | | 5/2003 |
| WO | WO-2012066907 | A1 | 5/2012 |

OTHER PUBLICATIONS

"International Application No. PCT/F12015/950358, International Search Report dated Aug. 24, 2015", (Aug. 24, 2015), 4 pgs.
"International Application No. PCT/FI2015/050358, Written Opinion dated Aug. 24, 2015", (Aug. 24, 2015), 7 pgs.
"Canadian Application Serial No. 2,951,359, Office Action dated Feb. 28, 2018", 7 pgs.
"European Patent Application No. 15806291.9 Response to Office Action dated May 7, 2018", 19 pgs.
"Canadian Application Serial No. 2,951,359, Response filed Aug. 15, 2018 to Office Action dated Feb. 28, 2018", 11 pgs.
"Canadian Application Serial No. 2,951,359, Office Action dated Nov. 23, 2018", 3 pgs.
"Canadian Application Serial No. 2,951,359, Response filed Mar. 29, 2019 to Office Action dated Nov. 23, 2018", 5 pgs.
"Canadian Application Serial No. 2,951,359, Office Action dated Jul. 22, 2019", 3 pgs.

* cited by examiner

METHOD FOR PRODUCING A WOOD PRODUCT BY MEANS OF HOT PRESSING AND USE OF METHOD

PRIORITY APPLICATIONS

This application is a U.S. National Stage Filing under 35 U.S.C. 371 from International Application No. PCT/FI2015/050358, filed on 25 May 2015, and published as WO2015/189461 on 17 Dec. 2015, which claims the benefit of priority to Finish Application No. 20145534, filed on 10 Jun. 2014; which applications and publication are incorporated herein by reference in their entirety.

The present invention relates to hot-pressing of a wooden blank, more specifically, to 2D and/or 3D directional hot-molding of a wooden blank by hot-pressing. In particular, the present invention relates to method of producing a wooden product by means of a molding hot-pressing from a wooden blank which has one or several sections, and to use of the method.

Such a method for production of a compressed wooden panel, for example, the building panel is known from GB 1426555. Method of the publication represents the closest prior art and comprises the steps of: a.) a mold is used, having a shape suitable for the production of a panel or a plurality of logs, b) into the mold is added liquid, c) a first pressure is applied to logs in the mold, d) the pressure is released and the logs are allowed to expand and absorb glue, e) e second pressure lower than the first pressure is subjecting to the logs, f) the mold and its contents are heated in an oven for baking the formed panel and g) the panel is removed from the mold. In the example of the publication the mold is heated to a temperature of 32° C., prior the first pressure, which is approx. 70 bar, is applied hydraulically. After the addition of adhesive and after the release of the pressure, a second pressure which is 35 bar is applied and the mold is inserted in the oven, where the temperature is 150° C. After the cooling, the panel is removed from the mold. The adhesive may be a phenolic resin, the saturation pressure may be between 55 and 105 bar at a temperature between 150 and 200° C. As preferred wood types are mentioned poplar, spruce or pine. The process is essentially characterized by the use phenolic resin, which is an adhesive, and absorption thereof in the mold into the wood material by releasing the first pressure load applied in the mold to the wood material at a first temperature, and then subjecting the second pressure to the wood material in the mold at the second load temperature. The process is therefore essentially a two-step process and is based on the absorption realized by means of the pressure variations.

JP 2003145511 discloses a method and an apparatus for producing of a building material and a molded timber product from a sawn timber which may be pine, Japanese cedar, thinning material or alike. The process according to the publication is a multi-step and proposes that the wood is first cooked, and then applying of resin and then impregnation by plastics. Publication does not disclose adhering of the sections.

The traditional production methods do not offer grounds for gluing or surface treatment of timber wetter than the export dry, 18-20%, and unplanned timber. It is well known the surface treatment of moist and saw surfaced timed with moisture of up to 24%, particularly external cladding-boards painting. The timber is generally dried to moisture of less than 22%, whereby it will remains without spoiling. For a good planing surface a planing dry timber with moisture of 15-18% is needed. The timber dried to 6-8% dryness before the planing and the subsequent distribution of the adhesive or coating material is needed for the furniture and similar conditions. A moisture removal taking place from inside of the product towards the surface is known previously. As a special technique may be mentioned a HFV dryuin that is based on high-frequency-technology/vacuum-drying (pressure <1 bar, and the drying time is few hours) for a pressurized impregnation of wood, whereby the product or products are inside a pressure chamber. Traditionally, a plain drying requires a period between 2 days and three weeks, excluding techniques for minor points of interest. Heat transferring from the room air of the drier space inwards from the surface of the wood, after binding moisture to itself is forced to leave the inside of the timber towards the surfaces, i.e. in the opposite direction and into the same room air having equal temperature/pressure. It well known to apply for extension in the wooden product butt joints and tongue/groove joints at side surfaces as well as fingers joints and tongue/groove joints at end surfaces. The production of joints takes place into the dried wood by machining and gluing. When using a traditional compression drying, flexural strength and stiffness are lost exponentially, because the height of the cross section of the product blank is reduced while squeezing the blank. The figure of the product height is squared in the Formula of flexural strength and cubed in the Formula of the stiffness. On the other hand without losing least of the product height, but by means of the difficult manageable squeezing or compacting of the wood material of the blank surface the flexural strength and stiffness of the product are increased.

The primary object of the present invention is to reduce the problems and disadvantages of conventional technics and to provide a new and inventive, particularly radically cost-effective method for producing a wood product by means of hot-pressing. In accordance with the object of the invention the target is to provide a method for producing a wooden product from wooden blank having one or several sections and for implementing a chemical treatment for the wooden blank in one and the same production process.

Generally, the object of the present invention has been achieved by the method mentioned at the beginning, Wherein as a material is selected an optional form of sawn timber or another timber, which is preferably selected from the group consisting of fresh sawn timber, dried timber, saw-surfaced lumber, planed timber, heat-treated timber, sodium silicate water-glass impregnated or salt impregnated or otherwise impregnated timber; wherein molding hot-pressing is performed essentially in a single-stage production process, which includes drying and molding hot-pressing of the wooden blank and essentially concurrent treating of the wooden blank both by binders of the wood itself and by treating chemicals and/or treating materials added in the production process which are selected from the group consisting of surface treatment agents, excipients, primers, impregnating agents, adhesives, adhesive films, adhesive gauzes; wherein the treatment chemicals are attached to the production process by using a hot-pressing pressing plate etc., pressing tool or pressing surface; and wherein the wood material, and binders thereof as well as the treating chemicals are allowed to adapt/move in relation to each other in the cooling phase of the production process until the locking phase, whereby the product is completed.

Such a one-step production process according to the general embodiment of the invention enables, in the same production process, together with the chemical treatment the pressing of the wooden blank: in the slope direction, i.e. a slope pressing; in a lateral direction, i.e. a cross-sectional dimensioning/profiling; and/or in the direction of the length, which is preferred and necessary, in particular for extending the length of the product and for profiling of the end surface.

As for the other specific features of the method, reference is made to the dependent claims 2-6. Both of the essential sub-processes of the present invention take place in the same production process and at the same time or at least partially simultaneously, whereby the wood material's own binders and treatment chemicals added among the wood material either prior to or during the production process, such as adhesives, surface treatment agents and/or impregnating agents, are in the process in a liquid state or in a state that mostly corresponds to the liquid state until bypass of the start of the cooling phase. This allows molding of the profile/volume of product blank and also parts thereof during the production process. In the cooling phase materials are solidified, which solidifies, i.e. locks the product into its final product shape. Because of this same reason, sizing of fresh and drier timber may take place only in the final dry timber which has processed wooden surfaces molded by the hot-pressing.

Treatment chemicals are bonded in the production process by hot-pressing to the wooden blank by pressing plate or by another fixed pressing tool composed of one or several parts. If needed, there is used a required protection surface, mantle, gauze or alike for each surface treatment agent and/or product surface shape/quality as attached to the tool or between the same and the product blank.

Material of the wood to be hot-pressed is selected among an optional form of sawn timber or another timber consisting of sawn fresh timber having moisture between 40% and 80%, dried timber, saw-surfaced lumber, planed timber, heat-treated timber, water-glass or salt impregnated timber.

The object of the chemical treatment of the product surface portion is plasticize the timber so as to be better condensing and profiling as well as the same to minimize the product compression and to provide product properties by the chemicals.

The both sub-processes of the present invention take place in the same production process and at the same time or at least partially simultaneously, whereby the wood's own adhesives and treatment chemicals added into the wood either prior or during the production process, such as adhesives, surfactants and/or impregnating agents, are in the process liquid or mostly liquid.

In the hot-pressing the treatment chemicals go deeper and more broadly into wood cells and adhere to it at the same time more strictly than by traditional means. This is achieved primarily through the high temperature and pressing pressure.

Holes within the wooden products/product elements, which are for example internal and external claddings, floor coverings, laminated wood, log, beam and pillar element, in the direction of length thereof and/or hollowed pressing tools allow in addition to a rapid moisture removal and receiving of surf treatment and/or impregnating agent through end faces thereof deep into the product blank by creating a strong vacuum with respect to the atmospheric pressure. In this case, changes occurring in the product blank and concerning humidity, pressure, temperature, changes of adhesive and surface treatment agents can be controlled from inside of blank surfaces by controlling discharge occurring outwards from the middle portions of its ends. Pressure and temperature are within the product blank, with respect to the atmospheric rates approx. 10 times higher, thus moisture discharge is really effective. Regardless of the cross-sectional area, the saw fresh wooden product blank is dried carpentry dryness and at the same is processed further as a surface treated product, even in a few hours. The space formed by longitudinal holes inside of the wooden blank, for example in in an intermediate floor element (hollow-core slab) can be also overpressurised instead of underpressurizing in order to remove moisture transferring from the blank into the space by reducing the difference between the evaporation pressure and discharge occurring outwards of the ends of the central portion of the blank. At the same time evaporation heat heats the inner surfaces, which then act also as the heat transfer surfaces. The desired overpressure and additional heat are possible to transfer into the space from outside, if desired, e.g. by means of air or steam. A counter pressure id possible to accomplish by the overpressure to the side of the internal surfaces of the blank. This permits the use of larger pressing pressure of the outer surfaces and the desired profiling and dimensioning all parts of the product. By means of the pressure brought from outside additional heat is also possible to transfer to the internal surfaces and, if necessary, to protect them at the end of the process by the surface or impregnating agent.

In the pressing process the surfaces to be bonded are formed to comply with structured surfaces of the topography of the timber. This is possible to do for all surfaces of the product blank to be glued. The structuring of the glue seam area can be increased particularly by high frequency heating. The heat therefrom is subjected to wood material of glue seam area that is more humid than the other parts wood material and to water of the glue, so the wood materials of glue seam are pressed more strongly into each other. In particular, the pressing of the side surfaces of the laminated wood and the lateral pressing of the lamellae thereof longitudinally, which permits structuring of the end surfaces of the lamella blanks, allow tight joints end to end—even without glue. The structured surfaces have special value at load-bearing flat surfaces of laminated wood components or laminae (wide). Of course, the value is also formed at side and end surfaces thereof (narrow), e.g. providing of conventional joints is not needed. Structured surfaces increase substantially the area of the glue seam, they function as joint friction or sliding barrier glue seam, the adhesive is bonded to the entire adhesive surface more evenly and wood material of the adhesive surface cannot easily be ruptured at the usage, because the wood material of adhesive surface is more homogeneous, the adhesive material, enhances heat transfer to surfaces of the glue seam, i.e. softens the wood to be structured by hot-pressing. It will also makes slippery subsidence of harder wood components inside the softer ones and the structuring will assist exploitation of the wood's own bonding agents for gluing wooden pieces together.

However, the adhesive bonding does not need to be very strong in all products, such as logs and bonded panels, and in particular beams and columns, where the glue seam in on the centerline of the cross-section. Then, the sizing occurring in the process is preferred already by weaker sizing than a traditional sizing. Potential damages of the results of the sizing are reduce disappearances of the wood's internal tensions in hot-pressing process. The glue adhesion may also strengthened, for example, by mechanical fasteners or by reinforcements.

In the pressing process, the surface of the product is got smooth, but also to correspond to the topography of the wood, when an elastic mantle as fixed to the pressing tool is used between the pressing tool and the product blank, and to correspond a desired embossed texture pattern, when a fixed mantle copying the same is used.

Objects of the present invention can be also achieved by a use of the a method according to the present invention for the production of the final product, whereby it is generally characterized that the product is selected from the product selected from the group consisting of: different pillar, beam, timbers, wall, intermediate floor, door, window, outer cladding, decking, gardening, inner cladding, flooring, laminated wood, plate elements and components thereof with one or several sections.

Regarding other specific features of the use, reference is made to the dependent claims 8-11.

According to one aspect of the use according to the present invention, it is essential to the use that for the manufacture of the product is used timber, which is selected from a group consisting of fresh sawn timber, dried timber, saw-surfaced lumber, planed timber, heat-treated timber, sodium silicate water-glass impregnated or salt impregnated or otherwise impregnated timber. According to a second aspect of the use according to the present invention it is essential to the use that the moisture, temperature and vapor pressure of the product blank are monitored as well as the use of binder and processing chemicals/materials is optimized by discharge, which is implemented from inside of the blank ends out of the ends of the blank by means of the pressing pressure against the surfaces of the wooden blank. According to a third aspect of the present invention, it is essential to the use that for providing at least one smooth surface, a surface with a topography of the timber, or a surface with a desired embossed texture pattern by means of the hot-pressing pressing surface. According to a fourth aspect of the present invention, it is essential to the use that films and/or gauzes are attached to the surface of the product by means of the hot-pressing.

Figure 2:
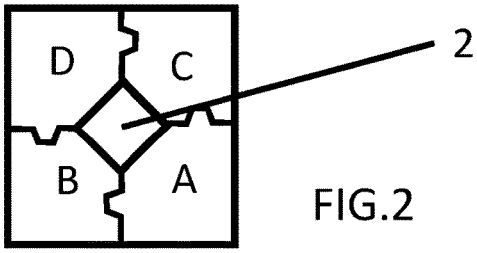
Figure 3:
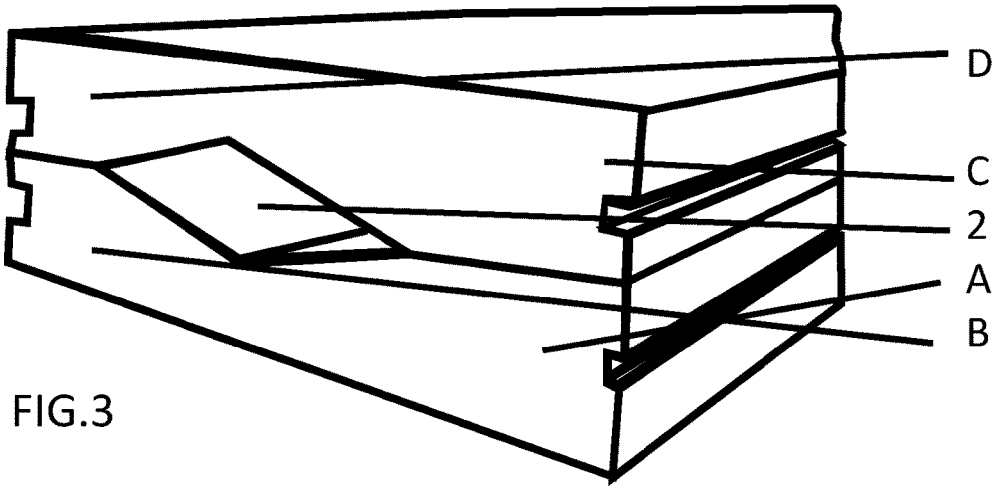

The present invention will be described below with reference to the accompanying drawing, which illustrates equipment and a wooden blank suitable for implementing the method and uses of the present invention. In the drawing, FIG. 1 presents a raw wood sawing pattern, FIG. 2 presents an exemplary wooden blank having several sections and assembled suitable for hot-pressing the final product that is a wooden pillar, and FIG. 3 presents an exemplary final product hot-pressed from wooden blank having several sections and central cavity.

The method according to the preferred embodiment of the invention for producing a wooden product from a wooden blank having one or several sections A, B, C, D by means of a hot-pressing is performed substantially in a one-step production process which comprises molding of the wooden blank by hot-pressing and substantially the same time treatment of the wooden blank both by means of wood's own binders and by added treating chemicals and/or materials selected from group consisting of surface treatment agents, excipients primer agents, impregnating products, adhesive agents, adhesive films and glue gauzes.

During implementation of the production process, it is preferred that the wood material and its binders as well as treatment chemicals may live/move in relation to each other until the locking at the cooling stage of the production process, whereby the product is completed. At the production process treatment chemicals can be bonded by using a hot-pressing pressing plate or a corresponding pressing tool or pressing surface.

In a production process the material to be treated may be selected quite freely. Material may be selected from the group consisting of a sawn timber or another timber in an optional form, for example, saw fresh or dried timber; saw surfaced timber; planed timber; heat treated timber; water-glass timber; or salt impregnated timber.

In a preferred embodiment of the present invention for providing a compression, the pressing is subjected mainly to a surface portion of the product blank, which may be compacted by the surface treatment in this connection.

During the substantially one-step production process according to the invention among other things moisture, temperature, vapor pressure, use of binders and treatment chemicals/materials can be monitored and optimized from inside 2 of the blank by means of discharge outwards from the ends of the blank and by means of the pressing pressure against the surfaces of the wooden blank.

When the single-step production process of the present invention is applied, the surfaces to be bonded are formed by the hot-pressing to comply with structured surfaces according to the topography of the timber. In this case, the advantage is that the surfaces are molded and dimensioned to correspond substantially each other, whereby the total areas of the facing surfaces to be bonded are significantly larger than what are an areas of sawn or planed surfaces. In this connection, however, it is emphasizes that by using in the one-step production process according to the present invention, a suitable pressing surface it becomes possible to form a smooth surface or the outer surface corresponding a timber topography or any outer surface having a desired embossed texture pattern.

The method of the present invention by means of which is carried out the substantially one-step production process, may be used for the manufacture of a product selected from the group consisting of: different pillar, beam, timbers, wall, intermediate floor, door, window, outer cladding, decking, gardening, inner cladding, flooring, laminated wood plate, kitchen cabinets, and furniture products/components. In this case, the sawn or another timber of an optional form to be used in the manufacture of the product can be selected from the group consisting of: sawn timber or other timber in an optional form, for example, saw fresh or dried timber; sawn timber surface; planed timber; heat treated wood; water glass timber; or salt impregnated wood.

Using the method according to the present invention for implementing the substantially one-step production process, it is possible to monitor and control during the process among other things the use of binders and treatment chemicals/materials from inside 2 of the blank by means of the discharge occurring outwards from the ends of the blank out of emissions, and by means pressing pressure against the blank surfaces.

For example, some preferred uses of the present invention are: the use for providing to the product at least one smooth surface, a surface corresponding to wood topography or surface with a desired embossed texture pattern by means of the hot-pressing pressing surface; and the use of attaching the films and/or gauzes surface of the product by hot-pressing.

The present invention has been described above only by means of few preferred embodiment thereof. Naturally, this is intended or desired to limit the present invention, but many alternatives and variations functionally equivalent are possible within the scope defined by the scope of the accompanying claims. Thus and relating to the present invention, it is further stated for the good sake of order as follows.

During the pressing phase, a structuring of the glue seam of the surface of final product can be increased by increasing the pressing pressure and especially the temperature of the target area, whereby the surface is squeezed more. The structuring will also grow, with the knots in the wood, and what more powerfully and helically differ from each other summerwood/springwood and what whorls are summerwood and springwood. A structured surface of the final product has particular value, e.g. for terrace board design as a slip resistance surface. One effective coating material for the terrace board is paraffin wax. A side pressing tool may serve a simple elastic or hard mat or list, e.g. mat or list of plastic. Product blanks that in parallel on flat plate with the slot mats or lists there between are pressed accurately to the same sum of widths measurement is not material. E.g. a plastic mat or list prevents the sticking of the side surfaces to each other because of effects of surface treatments agents and wood's own bonding agents.

It is possible to obtain a good flame retardant to a wooden massive product by hot-pressing a paste being composed of non-combustible materials, i.e. minerals, as well as of water-glass functioning as binders and/or of plastic on the surface of the product. Powders may be of nano-dimensional category to obtain additional features of the nano-technology. Powders of the nano-dimensional category may carry the paste deep into the wood. It is also essential at that same there achieved a treatment which brings even conventional the product features.

The invention claimed is:

1. A method of producing a wooden product by means of a molding hot-pressing from a wooden blank which has one or several sections, wherein a material is selected from the group consisting of fresh sawn timber, dried timber, saw-surfaced lumber, planed timber, heat-treated timber, sodium silicate water-glass impregnated or salt impregnated or otherwise impregnated timber;

wherein molding hot-pressing is performed essentially in a single-stage production process, which includes drying and molding hot-pressing of the wooden blank and essentially concurrent treating of the wooden blank both by binders of the wood itself and by treating chemicals or materials added in the production process which are selected from the group consisting of surface treatment agents, excipients, primers, impregnating agents, adhesives, adhesive films, adhesive gauzes, wherein the treatment chemicals are attached to the production process by using a hot-pressing pressing plate, pressing tool, or pressing surface;

wherein moisture, temperature, vapor pressure, use of binders, and treatment chemicals or materials are monitored and optimized from inside of the blank by discharge outwards from the ends of the blank and by pressure pressing against the surfaces of the wooden blank; and wherein the wood material, and binders thereof as well as the treating chemicals are allowed to adapt and move in relation to each other in the cooling phase of the production process until the locking phase, whereby the product is completed.

2. The method according to claim 1, wherein the pressing is subjected mainly to a surface portion of the wooden blank, which is also compacted by the surface treatment.

3. The method according to claim 1, wherein surfaces to be bonded are molded by hot-pressing to comply with structured surfaces according to the topography of the timber.

4. The method according to claim 1, wherein the product is provided by means of the molding hot-pressing with a smooth surface, with a surface topography of the timber, or with surface with a desired embossed texture pattern is provided.

5. The method according to claim 1, characterized by the molding hot-pressing in the direction of the wooden blanks for extending the length of the product and/or for form-pressing ends of the product.

6. A use of the method according to claim 1 for the manufacture of a product selected from the group consisting of: different pillar, beam, timbers, wall, intermediate floor, door, window, outer cladding, decking, gardening, inner cladding, flooring, laminated wood, plate elements and components thereof with one or several sections.

7. The use according to claim 6, for the manufacture of a wooden product from sawn timber or another timber selected from a group consisting of fresh sawn timber, dried timber, saw-surfaced lumber, planed timber, heat-treated timber, sodium silicate water-glass impregnated or salt impregnated or otherwise impregnated timber.

8. The use according to claim 6 for providing at least one smooth surface, a surface with a topography of the timber, or a surface with a desired embossed texture pattern by means of the hot-pressing pressing surface.

9. The use of the method according to claim 1 wherein films and/or gauzes are attached to the surface of the product by means of the hot-pressing.

10. A method of producing a wooden product by means of a molding hot-pressing from a wooden blank which has one or several sections, wherein a material is selected from the group consisting of fresh sawn timber, dried timber, saw-surfaced lumber, planed timber, heat-treated timber, sodium silicate water-glass impregnated or salt impregnated or otherwise impregnated timber;

wherein the molding of the wooden blank by hot-pressing, treatment of the wooden blank with binders of the wood itself and treating chemicals or treating materials, and attachment of the treatment chemicals to the wooded blank through a hot pressing plate, pressing tool, or pressing surface is performed in a substantially one-step production process, wherein the treatment chemicals are selected from the group consisting of surface treatment agents, excipients, primers, impregnating agents, adhesives, adhesive films, adhesive gauzes;

wherein the wood material, wood binders, and treating chemicals are allowed to adapt and move in relation to each other in the cooling phase of the production process until the locking phase, whereby the product is completed; and wherein moisture, temperature, vapor pressure, use of binders, and treatment chemicals or materials are monitored and optimized from inside of the blank by discharge outwards from the ends of the blank and by pressure pressing against the surfaces of the wooden blank.

11. The method according to claim 10, wherein the pressing is subjected mainly to a surface portion of the wooden blank, which is also compacted by the surface treatment.

12. The method according to claim 10, wherein surfaces to be bonded are molded by hot-pressing to comply with structured surfaces according to the topography of the timber.

13. The method according to claim 10, wherein the product is provided by means of the molding hot-pressing with a smooth surface, with a surface topography of the timber, or with surface with a desired embossed texture pattern is provided.

14. The method according to claim 10, characterized by the molding hot-pressing in the direction of the wooden blanks for extending the length of the product and/or for form-pressing ends of the product.

15. A use of the method according to claim 10 for the manufacture of a product selected from the group consisting of: different pillar, beam, timbers, wall, intermediate floor, door, window, outer cladding, decking, gardening, inner cladding, flooring, laminated wood, plate elements and components thereof with one or several sections.

16. The use according to claim 15, for the manufacture of a wooden product from sawn timber or another timber selected from a group consisting of fresh sawn timber, dried timber, saw-surfaced lumber, planed timber, heat-treated timber, sodium silicate water-glass impregnated or salt impregnated or otherwise impregnated timber.

17. The use according to claim 15 for providing at least one smooth surface, a surface with a topography of the timber, or a surface with a desired embossed texture pattern by means of the hot-pressing pressing surface.

18. The use of the method according to claim 10 wherein films and/or gauzes are attached to the surface of the product by means of the hot-pressing.

* * * * *